United States Patent [19]

Birkner

[11] Patent Number: 4,862,136

[45] Date of Patent: Aug. 29, 1989

[54] PROGRAMMABLE RESISTANCE NETWORK

[76] Inventor: John M. Birkner, 330 N. Mathilda, #112, Sunnyvale, Calif. 94086

[21] Appl. No.: 484,396

[22] Filed: Apr. 13, 1983

[51] Int. Cl.[4] ..... H01C 10/10

[52] U.S. Cl. ..... 338/195

[58] Field of Search ..... 338/195, 203, 48, 89, 338/92, 95, 97

[56] References Cited

U.S. PATENT DOCUMENTS

| | | | |
|---|---|---|---|
| 3,441,804 | 4/1969 | Klemmer | 338/308 |
| 3,930,304 | 1/1976 | Keller et al. | 338/195 X |
| 4,016,483 | 4/1977 | Rudin | 338/92 |
| 4,197,521 | 4/1980 | Rovnyak | 338/195 |
| 4,298,856 | 11/1981 | Schuchart | 338/195 |

FOREIGN PATENT DOCUMENTS

| | | |
|---|---|---|
| 1520 | 4/1979 | European Pat. Off. . |
| 144980 | 11/1980 | Fed. Rep. of Germany . |
| 4725938 | 10/1968 | Japan . |
| 2001478 | 1/1979 | United Kingdom . |

*Primary Examiner*—E. A. Goldberg
*Assistant Examiner*—M. M. Lateef
*Attorney, Agent, or Firm*—Townsend & Townsend

[57] ABSTRACT

A programmable resistor network and a method for forming and programming same. The network includes a plurality of independent programmable resistor arrays in a standard DIP semiconductor package. Each resistor array includes a plurality of parallel connected resistor elements capable of being selectively deleted from the array by applying a programming flow of electricity across a first and second DIP pin. The flow of electricity is of a value sufficient to progressively fuse successive array resistors. The total array resistance value progressively increases as array resistors are selectively deleted. Typically an increasing flow of electricity is applied across the array terminals until the desired array resistance value is obtained. The arrays may be manufactured in such a way that the incremental value between successive resistive elements causes the total array resistance value to increase in any desired manner, e.g. geometrically, arithmetically, and logarithmically.

25 Claims, 2 Drawing Sheets

PROGRAMMABLE RESISTANCE NETWORK

BACKGROUND OF THE INVENTION

1. Field of the Invention

The present invention relates to resistor networks. More particularly, the present invention relates to programmable, integrated circuit resistance networks.

2. Description of the Prior Art

Active and passive integrated circuits are known. Additionally, programmable active integrated circuits are known. However, manufacturers and designers must rely on off-the-shelf standard values for passive devices, such as resistors.

Typically, resistors have been designed as discrete components—with one fixed-value resistor in each component package. More recently, thin film and thick film integrated circuit technology have been applied to the manufacture of resistors and other such passive devices. Arrays of fixed value resistors are now available in standard dual in-line pin (DIP) packages. Typical of such devices are the Thick Film DIP Resistor Networks Manufactured by TRW Corporation of Redondo Beach, Calif.

Placing fixed value resistors in DIP packages is a substantial improvement in the passive device art. A single DIP package can accommodate several fixed value resistors in less space than that required by the equivalent discrete resistors. Additionally, a DIP package of several resistors can be easily inserted as a unit into and soldered to a printed circuit board during manufacturing processes, in contrast to discrete resistors which require a separate insertion operation for each such device.

While representing an improvement over discrete resistors, the DIP resistor networks with fixed standard values often present design problems. Specifically, the network may contain some resistor values that are usable and others that are not usable in a particular circuit. Thus, part of the network occupies space on a printed circuit board without performing a function. In addition, the standard values provided in existing resistor networks are selected by the manufacturer's criteria, which is typically an omnibus attempt to provide fixed values having wide application. Forced to accept the standard values, the designer is often tempted to compromise a particular circuit design in order to render the standard value network usable for production purposes. One way of achieving some additional flexibility with existing DIP resistor networks has been to connect the fixed resistors in series or in parallel and thus obtain new values. However, this approach uses two resistors to achieve a value that should be available with one resistor. Additionally, printed circuit board patterns must be especially designed to accommodate such jury rigging which complicates the circuit board layout procedure. Further, the range of possible resistance values available by this technique is still relatively narrow and usually does not represent the optimum resistance values for the particular circuit of interest.

It is possible to order custom resistor networks having the specific values desired. This approach requires the use of special integrated circuit masks during the network manufacturing process. As a result, such custom chips are quite expensive and usually cannot be justified for the designer or the small or moderate scale manufacturer. Efforts to date to provide resistor networks devoid of the above disadvantages have not met with success.

SUMMARY OF THE INVENTION

The present invention is a programmable resistor network capable of providing an exceedingly wider angle of user selectable resistance values, and a method for forming and programming same. The programmable resistor network provides a versatile and inexpensive programmable passive device that affords a designer or manufacturer a degree of flexibility hitherto unavailable. A single resistor array produced according the present invention provides a wide range of resistors in one component that would otherwise require the stocking of a large inventory of individual value resistors. Initially, the programmable resistor network provides a variety of incremental resistor contours for various applications such that resistance may be optimized to required circuit parameters, rather than being compromised by off-the-shelf values that may not be exactly correct for the circuit. Thus, the present invention provides a device that eliminates the need for a large inventory of different valued discrete resistor components, the need to produce expensive custom resistor arrays, and the need for special circuit board designs to produce required resistance values by jury rigged combinations of standard values.

The network includes a plurality of independent programmable resistor arrays in a standard DIP semiconductor package. Each resistor array includes a plurality of parallel connected resistor elements capable of being selectively deleted from the array by applying the programming flow of electricity across a first and second DIP package pin. The flow of electricity is of a value sufficient to progressively fuse successive array resistors. The total array resistance value progressively increases as array resistors are selectively deleted. Typically, an increasing flow of electricity is applied across the array terminals until the desired array resistance value is obtained. The arrays may be manufactured in such a way that the incremental value between successive resistance elements causes the total array resistance value to increase in any one of a number of desired progressions, e.g., geometrically, arithmetically, logarithmically and the like.

The network may be produced by depositing a film resistor layer onto a silica substrate in accordance with a predetermined pattern. The film resistor layer forms a resistor array wherein each individual resistance element establishes an incremental resistance value for the array. An ohmic conductive layer is deposited upon the substrate and over the resistor array to create a connector grid that forms terminals connected to the resistor array. By forming the conductive layer with a selelcted conductor contour the incremental length of successive resistive elements is varied. The rate at which the resistive element rates vary progressively increases the total resistor array resistance value according a selected incremental progression as successive resistive elements are fused during the programming processes.

The resistor network may be packaged in a standard DIP package having a plurality of resistor arrays. Each DIP package therefore may contain any desired number of programmable resistor arrays. The networks are mounted in and operate in various circuits in place of standard value discrete resistors or standard fixed value network resistors while providing the flexibility of using a single component for a wide range of component values and applications.

For a further understanding of the nature and advantages of the invention, reference should be had to the ensuing detailed description taken in conjunction with the accompanying drawings.

DETAILED DESCRIPTION OF THE PREFERRED EMBODIMENTS

Figure 1:
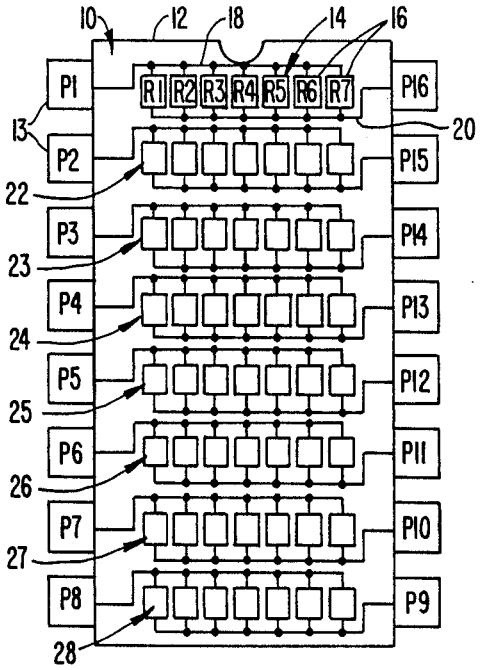
FIG. 1 is a schematic representation of a resistor network according to the present invention.

The present invention provides a programmable resistor network 10 as shown schematically in FIG. 1. Resistor network 10 is contained in an integrated circuit package 12 having two rows of pins 13. Such packages are commonly referred to as dual in-line pin (DIP) packages.

The integrated circuit package 12 contains a plurality of resistor arrays (14, 22–28). Each resistor array is comprised of a plurality of resistive elements 16 connected in parallel between a first common terminal 18 and a second common terminal 20. In the example in FIG. 1, resistor array 14 comprises resistive elements R1–R7 connected in parallel between pins P1 and P16.

Figure 2:
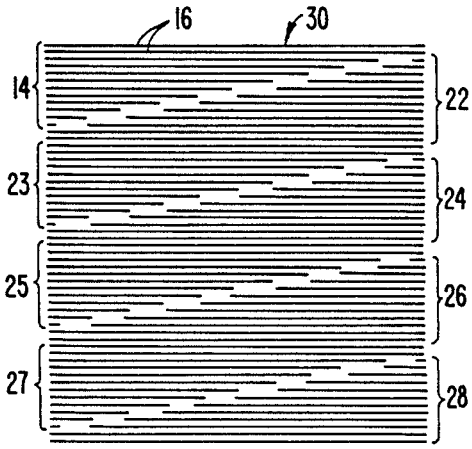
FIG. 2 shows a pattern of resistive elements for producing eight resistor arrays according to the present invention.

Referring now to FIG. 2, the arrangement of the resistor arrays 14, 22–28, is shown. The resistive elements 16 are arranged parallel to each other and are of an increasing length. In the exemplary embodiments of the invention, twelve such resistive elements 16 are shown. As the length of the resistive elements increases the resistance of the element progressively increases. Thus, the incremental increase in length of each resistive element in each array provides an incremental increase in resistance of each element.

Figure 3:
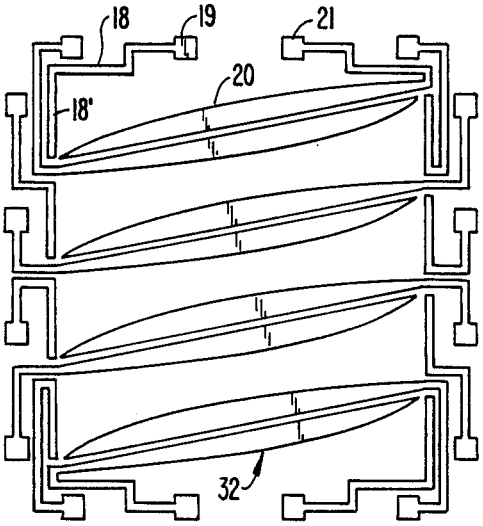
FIG. 3 is a pattern of resistive element connecting terminals for producing eight resistive arrays according to the present invention.

FIG. 3 shows a first common terminal 18 to be connected to one end of resistor array 14 and a second common terminal 20 to be connected to a second end of resistor array 14. The terminals 18 and 20 are provided with connection pads, 19 and 21 respectively, by which each resistor array may be connected to the external DIP package pins. Terminal 18 has a portion 18' arranged substantially perpendicular to one end of the resistor array. As noted above, the resistor elements 16 are of a progressively increasing length. Therefore, terminal 20 is arranged askew from terminal 18 and at an angle thereto such that the other end of each resistive element 16 in the resistor array is also contacted.

Figure 4:
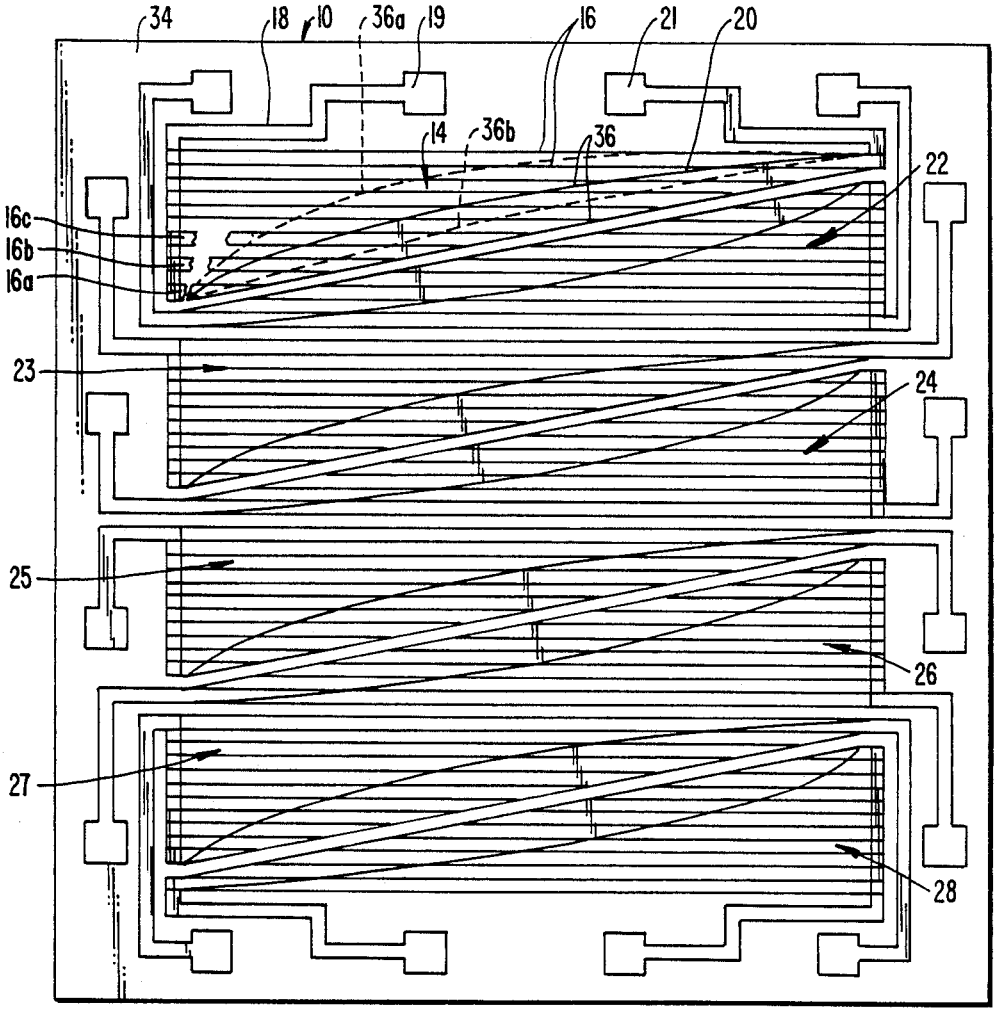
FIG. 4 is a composite of FIG. 2 and FIG. 3 showing a programmable resistor network including eight arrays of resistor elements and associated element connecting terminals.

An exemplary embodiment of the programmable resistance network 10 is shown in FIG. 4 in composite form wherein a resistive layer 30 (as also shown in FIG. 2) and a conductive layer 32 (as also shown in FIG. 3) are superimposed, upon a semiconductor substrate 34, the conductive layer overlying the resistive layer. The embodiment of network 10 shown in FIG. 4 includes 8 resistor arrays, 14 and 22–28. Each array consists of a plurality of resistance elements 16 arranged in parallel and interconnected between a first terminal 18 and a second terminal 20 as described above. In the exemplary embodiment of the invention, resistance network 10 is manufactured by sputtering a 500 Angstrom resistive layer 30 onto a silica substrate 34. One suitable resistive layer is a compound consisting of 10% titanium and 90% tungsten; other suitable compounds will occur to those skilled in the art. The resistive layer is applied to the silica substrate; the pattern of resistive elements 16 is created by etching the resistor layer according to known photolithography techniques. In the present embodiment of the invention, the resistor element edges are spaced three micron apart and the elements have a width of three microns.

After the resistive layer is applied and contoured, a conductive layer 32 of a suitable ohmic metallic conductor, such as aluminum, is deposited onto resistor layer 30 and the exposed substrate 34 using conventional deposition techniques, such as sputtering or evaporating. An ohmic conductive connector pattern is then created by removing portions of the metal conductor layer through known photolithography techniques.

After the resistance network 10 is formed it is mounted in a DIP package 12 (FIG. 1) using conventional techniques and connections are made between the network connection pads (e.g. 19, 21, etc.) and the DIP package pins 13 (P1–P16). It should be appreciated that the method of manufacture as discussed above is subject to many variations. For example, the resistive layer could be comprised of other resistive compounds, the device could be mounted in a package other than a DIP package, etc.

Resistor network 10 is intended to provide a plurality of programmable resistor arrays in a single integrated circuit package. In the exemplary embodiment of the invention, eight such programmable arrays are shown. To program a given array, a programming flow of electricity is provided across the array through the DIP package pins associated to that array. Thus, array 14 is programmed by providing a programming flow of electricity between pins P1 and P16 (FIG. 1), array 22 is programmed by providing a programming flow of electricity between pins P2 and P15, etc. The programming flow of electricity may be a progressively increasing current or voltage. As the programming flow is increased, successive resistive elements fuse. Fusing occurs because the voltage or current exceeds the voltage or current carrying capacity of the particular resistive element. Thus, element **16*a* (FIG. 4), having less surface area, fuses first, followed by elements 16*b*, 16*c*, etc. as illustrated in FIG. 4 for the first three elements 16*a*–16*c***. By progressively increasing the programming flow, additional resistive elements are fused until the desired total array resistance value is obtained.

As described above the resistive elements are connected in parallel and are of an increasing length that provides an increasing resistance value for each particular element. Thus, as each successive resistive element is fused, the total array resistance increases according to the formula for parallel resistance, wherein:

$$R_{total} = \frac{1}{1/R_1 + 1/R_2 + \ldots 1/R_n}$$

where:

$R_{total}$ = total array resistance value, and $R_1$, $R_2$, etc.=the resistance value of each individual array element.

Conductive layer 32 is formed according to a predetermined mask pattern by photolithographic techniques as discussed above. The shape of connecting terminal 20, in addition to serving to connect the ends of each resistive element remote from terminal 18 in order to form a circuit composed of parallel resistive elements, also serves to determine the manner in which each successively fused resistive element increments the total array resistance value. The shape of the outer edge 36 of connecting terminal 20 affects the effective length of each resistive element 16. This is shown in FIG. 4 by broken lines 36*a* and 36*b*. The increasing programming electrical flow may fuse successive resistive elements and thereby increase total array resistive in a very gradual manner, or in a very sudden manner. The total array resistance may be increased linearly, logarithmically, according to a simple interest rate, geometrically, exponentially, arithmetically, hyperbolically, etc.

The following formulae provide illustrative examples of some of the incremental contours by which total array resistance may increase:

(1) Linear:

$$1/R_{total}=1/R_1=1/R_2+1/R_3+\ldots+1/R_N$$

where:

$R_{total}$=Total array resistance value, $R_1$, $R_2$, $R_3$, . . . , $R_N$ are array resistors, and $R_2=R_1+C$ (C=A constant incremental value), $R_3=R_2+C$, $R_N=R_{N-1}+C$;

(2) Simple interest rate:

$$1/R_{total} = 1/R_1 + 1/R_2 + 1/R_3 + \ldots + 1/R_N = \frac{1}{R_1}\,\frac{1-\left[\frac{1}{1+d}\right]^{N+1}}{1-\frac{1}{1+d}}$$

where:

$R_{total}$=Total array resistance value;

$R_1$, $R_2$, $R_3$ . . . $R_N$ are array resistors $R_K=R_{K-1}[1+d]$

N=Number of array resistors, and $1<K\leqq=N$ $0<d<1$

A program for a computer analysis of an experimental resistor array is included as an appendix to provide an example of total array values obtained by fusing successive array resistors with application of a constantly increasing programming voltage. The example shows a total array resistance value increase according to the simple interest rate formula, where:

N=Number of array resistors,

R=Total array resistance value,

%=Difference between array resistance values,

V=Programming voltage;

I=Programming current;

P=Programming power,

L=Total length of lowest valued remaining array resistor, and

D=Difference in length between adjacent array resistors.

Once programmed, resistor network 10 may be placed in any compatible electronic circuit. Circuit voltage, current, and power levels should not approach network programming levels. In the preferred embodiment of the invention, the programming flow of electricity is substantially larger than those flows that may be encountered during normal circuit operation.

As will now be apparent, programmable resistor arrays fabricated according to the teachings of the invention afford a degree of flexibility to the circuit designer which has hitherto been unavailable. For example, the circuit designer or manufacturer now has available in one component the wide range of resistances that previously required a large inventory of individual value resistors. The designer or manufacturer cannot run out of a critical resistor value when needed. Purchasing is made a simple matter, resulting in lower acquisition and stocking costs. Manufacturing costs of the programmable resistance network are low while yields are high. The availability of various programming slopes wherein resistance may increase in any desired numerical progression allows the designer an infinite range of resistance values. In this way circuits may be optimized by selecting the exact resistance value required for the application, rather than compromised by settling for a "close" standard value. Thus, custom chips, special circuit board designs, and jury-rigging to obtain desired resistances are eliminated.

The foregoing was given by way of illustration and example. It is to be understood that the present invention is subject to various modifications, all within the scope of the claimed subject matter. For example, the programmable resistance network may be produced as a single array resistive element or as a plurality of resistive element arrays. Additionally, each resistive element may be formed of the same length but of different thicknesses, or each resistive element could be formed to have the same resistance value yet be subject to fusing at different levels of electric flow. Furthermore, the resistor arrays may be formed to handle any desired voltage, current, or power level any may thus be formed in many different sizes and shapes. Therefore, the scope of the invention should be limited only by the breadth of the claims.

APPENDIX

```
INTERGER N,K,R,P,VP,IP,PP,L,D
REAL SG,SG0,DELTA,G,IB,OHMSPM,PERCNT
OHMSPM=20.0
PERCNT=0.001
N=1
DELTA=1.0/50000
IB=0.010
SG=DELTA
SG0=15*SG
WRITE(6,200)
FORMAT(' ',/,/,
C' N R % V I P L D',/)
P=(DELTA/SG)*100
VP=IB/DELTA
R=1/SG
IP=IB*SG*1000/DELTA
PP=IB*SG/(DELTA*DELTA)
L=1(OHMSPM*DELTA)
D=(1.0/OHMSPM*DELTA)) -
(1.0/(OHMSPM*(DELTA+PERCNT*(SG+SG0))))
WRITE(6,100) N,R,P,VP,IP,PP,L,D
FORMAT(' ',8I7)
DELTA=DELTA+PERCNT*(SG+SG0)
SG=SG+DELTA
N=N+1
IF(R.GT.20) GOTO 10
STOP
END
```

I claim:

1. A programmable resistance network, comprising:

an array of resistors capable of being selectively deleted by applying a programming flow of electricity across first and a second array terminals, said flow of electricity having a value sufficient to progressively fuse successive array resistors, each successive array resistor having the property of being fusible at a progressively greater flow of electricity than that of preceding array resistors.

2. The resistance network of claim 1, further comprising each successive array resistor having a progressively higher resistance value than that of a preceding array resistors.

3. The programmable resistance network of claim 1, further comprising a plurality of independent programmable resistor arrays.

4. A programmable resistance network, comprising:

an array of resistors capable of being selectively deleted by applying a programming flow of electricity across a first and a second array terminal, said flow of electricity having a value sufficient to progressively fuse successive array resistors, the total array resistance being progressively increased as said array resistors are selectively deleted.

5. A method of manufacturing a programmable resistance network, comprising:

depositing a film resistor layer comprising a compound of titanium and tungsten onto a substrate in accordance with a predetermined resistance pattern to form a resistor array, said array establishing an incremental resistance value for each resistor in the array; and depositing a conductive layer, according to a predetermined pattern, onto said substrate and over said resistor array to create a connector grid for forming terminals connected to said resistor array; wherein successively fusing said resistors by application of an increasing flow of electricity progressively increases total array value.

6. A programmable resistance network, comprising:

a first elongate resistor array terminal;

a second elongate resistor array terminal askew from said first terminal; and a plurality of parallel resistors connected as an array between said first and second terminals, each successive resistor having a progressively higher resistance value than that of preceding resistors, said resistors having the property of being selectively deletable by applying an increasing flow of electricity across said first and second terminals to progressively fuse successive array resistors.

7. The resistance network of claim 6, further comprising each successive array resistor having a progressively higher resistance value than that of preceding array resistors.

8. The resistance network of claim 6, wherein total array resistance value is progressively increased as said array resistors are selectively deleted.

9. The resistance network of claim 8, wherein said total array resistance value has the property of increasing linearly.

10. The resistance network of claim 8, wherein said total array resistance value has the property of increasing logarithmically.

11. The resistance network of claim 8, wherein said total array resistance value has the property of increasing according to a simple interest rate.

12. The resistance network of claim 8, wherein said total array resistance value has the property of increasing geometrically.

13. The resistance network of claim 8, wherein said total array resistance value has the property of increasing exponentially.

14. The resistance network of claim 8, wherein said total array resistance value has the property of increasing arithmetically.

15. The programmable resistance network of claim 8, wherein said total array resistance value has the property of increasing hyperbolically.

16. The resistance network of claim 6, further comprising a plurality of independent programmable resistor arrays.

17. An integrated circuit programmable resistance network, comprising:

a first elongate resistor terminal;

a plurality of elongate parallel film resistors of progressively increasing length, said resistors having a first end connected to, and substantially perpendicular to said first terminal, each resistor having a resistance value that is a function of its length; and a second elongate resistor terminal connected to said resistors at a second resistor end, said resistors having the property of being selectively deletable by applying an increasing flow of electricity across said first and second terminals to progressively fuse successive resistors.

18. The resistance network of claim 17, wherein said increasing flow of electricity is an increasing electrical voltage.

19. The resistance network of claim 17, wherein said increasing flow of electricity is an increasing electric current.

20. The resistance network of claim 17, further comprising a plurality of independent programmable resistor arrays.

21. In an integrated circuit including a semiconductor substrate and having a dual in-line pin (DIP) package, a monolithic programmable resistor network, including a plurality of independent resistor arrays, each resistor array comprising:

a film resistor layer deposited onto said substrate, said resistor layer arranged to form a pattern of parallel resistive layer arranged to form a pattern of parallel resistive elements, each successive resistance element being of greater length and resistance value than that preceding it; and a conductive layer deposited onto said resistive layer, said conductive layer arranged to form a first resistor array terminal at one end of said parallel resistive elements and to form a second resistor array terminal at another end of said parallel resistive elements, said first and second resistor array terminals being connected to a first and second DIP package pin, respectively, wherein a selected flow of a programmable voltage provided across said first and second DIP package pins progressively fuses successive resistive elements in said resistor array and provides a progressively increasing total resistor array resistance value.

22. The resistor array of claim 21, further comprising said second resistor array terminal having a selectable contour for varying incremental length of successive resistive elements and for progressively increasing total resistor array resistance value according to a selected incremental progression as successive resistive elements are fused.

23. A method of selecting a desired resistance value, comprising progressively fusing successive resistors in a resistor array by applying a progressively greater flow of electricity across array terminals including the step of progressively increasing total array resistance value by selectively deleting said array resistors.

24. A method of manufacturing a programmable resistance network, comprising:

depositing a film resistor layer onto a substrate in accordance with a predetermined resistance pattern to form a resistor array, said array establishing an incremental resistance value for each resistor in the array; and depositing an aluminum layer, according to a predetermined pattern, onto said substrate and over said resistor array to create a connector grid for forming terminals connected to said resistor array; wherein successively fusing said resistors by application of an increasing flow of electricity progressively increases total array value.

25. A method of manufacturing a programmable resistance network comprising:

depositing a film resistor layer onto a substrate in accordance with a predetermined resistance pattern to form a resistor array, said array establishing an incremental resistance value for each resistor in the array; and depositing a conductive layer, according to a predetermined pattern, onto said substrate and over said resistor array to create a connector grid for forming terminals connected to said resistor array; wherein successively fusing said resistor by application of an increasing flow of electricity progressively increases total array value, said step of depositing including the step of varying the incremental length of successive resistive elements by forming said conductive layer with a selected conductor contour to progressively increase total resistor array resistance value according to a selected incremental progression as successive resistive elements are fused.

* * * * *